United States Patent [19]

Stubbmann

[11] 3,978,610

[45] Sept. 7, 1976

[54] MOBILE

[75] Inventor: Albert Stubbmann, Franklin Lakes, N.J.

[73] Assignee: Kohner, Inc., New York, N.Y.

[22] Filed: Sept. 24, 1975

[21] Appl. No.: 616,358

[52] U.S. Cl. ..... 46/32; 248/102; 248/226 E

[51] Int. Cl.[2] ..... A63H 33/00

[58] Field of Search ..... 40/128, 138; 46/1 R, 46/32; 24/211, 213, 119; 248/102–104, 226 E, 204

[56] References Cited

UNITED STATES PATENTS

| | | | |
|---|---|---|---|
| 1,436,367 | 11/1922 | Sullivan | 46/32 |
| 3,014,307 | 12/1961 | Dupuis | 46/1 R |
| 3,143,374 | 8/1964 | Carboni | 248/102 |
| 3,290,817 | 12/1966 | Kravath | 46/32 |
| 3,425,653 | 2/1969 | Rauch | 248/104 |

*Primary Examiner*—Louis G. Mancene
*Assistant Examiner*—Robert F. Cutting
*Attorney, Agent, or Firm*—Seidel, Gonda & Goldhammer

[57] ABSTRACT

A flexible arcuate rod is rotatably supported by a pair of elastic clips. Each clip slidably engages a crib wall or a crib headboard. One or more annular members are slidably mounted on the rod. Each annular member is provided with a tab from which a figure such as a paper or plastic cut-out or a painted decoration can depend. A pair of tubes is slidably mounted on the rod to prevent displacement of the annular members over predetermined portions of the rod.

12 Claims, 4 Drawing Figures

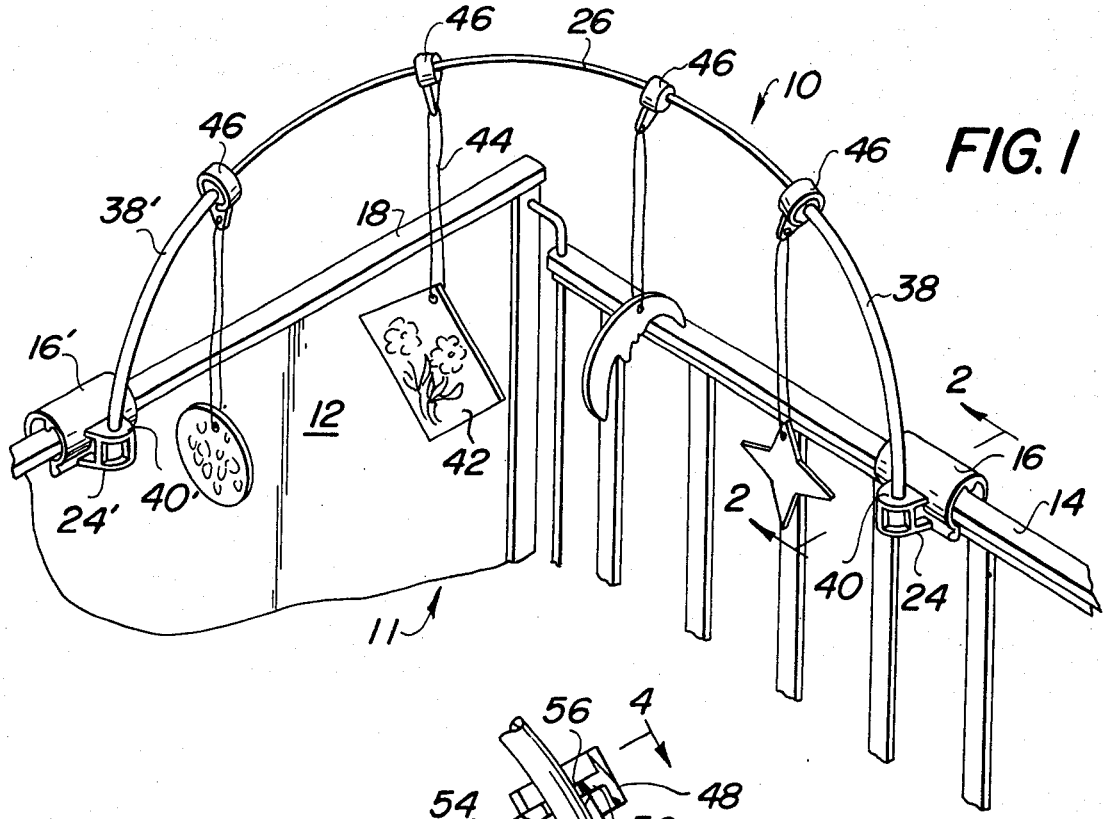
FIG. 1
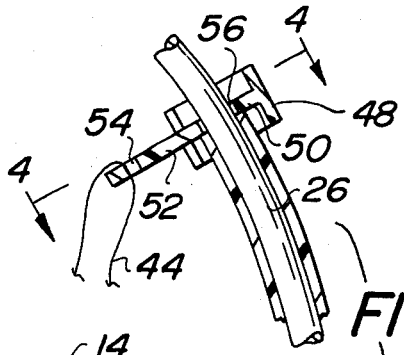
FIG. 2
FIG. 3
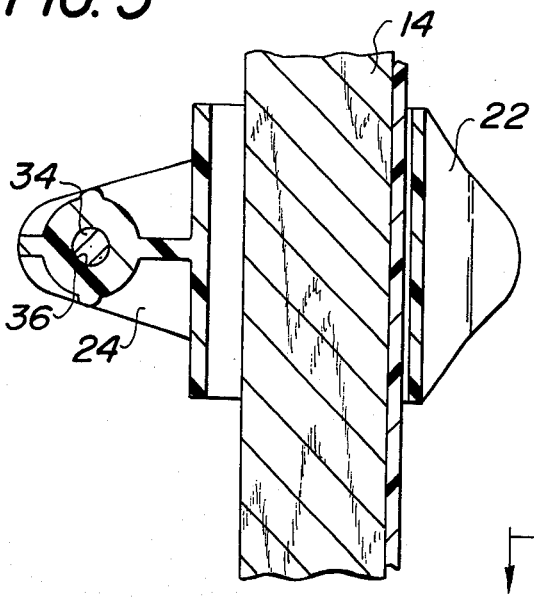
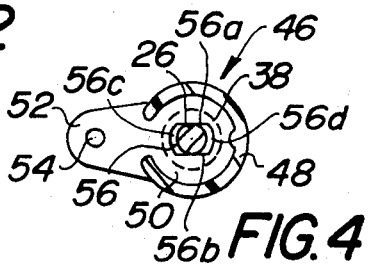
FIG. 4
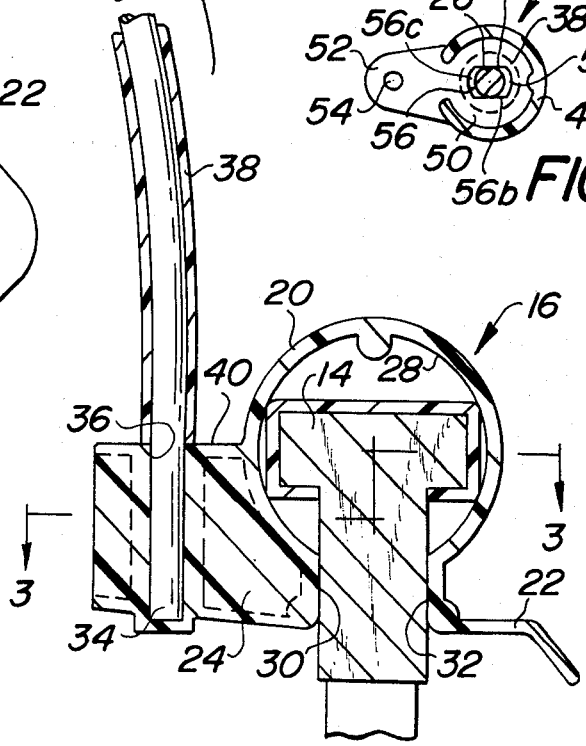

MOBILE

BACKGROUND OF THE INVENTION

The present invention relates to a mobile which slidably attaches to a crib. More specifically, the present invention relates to a pre-assembled mobile having no loose parts which may be slidably attached to the crib rail or the crib headboard. Figures suspended from the mobile are movable thereon without falling within the reach of an infant occupying the crib.

Mobiles having arch shaped frames from which a plurality of objects may depend are well-known in the art. For example, in U.S. Pat. No. 1,436,367 issued to Sullivan, there is shown a rigid arcuate rod from which a plurality of objects depend. The objects are fixed in position on the rod. The rod is permanently attached to a highchair or the like by brackets and screws.

It is also known to support an object on a rigid frame by means of a spring clip or elastic clamp. U.S. Pat No. 1,186,845, for example, shows a holder for nursing bottles wherein the bottle is hung from a rigid telescopic supporting rod. The rod must support the weight of the bottle without deforming. The rod must be screwed to a pair of spring clips which are attachable to a hospital bed.

The primary advantage of the present invention is that one or more figures suspended from the mobile may be adjustably positioned thereon.

Another advantage of the present invention is that the displacement of the figures may be limited to prevent the figures from falling within the reach of an infant occupying the crib.

A further advantage of the present invention is that it may be slidably attached to the rail or the headboard of the crib, either across a corner of the crib, across the width of the crib, or on one side of the crib.

A still further advantage of the present invention is that it is pre-assembled and has no loose parts.

Other advantages of the present invention appear in the detailed description hereinbelow.

BRIEF SUMMARY OF THE INVENTION

A mobile for slidable attachment to a crib comrises a flexible arcuate rod, means slidably mounted on the rod for suspending figures therefrom, means slidably mounted on the rod for limiting displacement of the suspending means on the rod, and elastic means for rotatably supporting the rod and for frictionally engaging the crib while being slidable thereon.

BRIEF DESCRIPTION OF THE DRAWINGS

FIG. 1 is a perspective view of a mobile constructed in accordance with the principles of the present invention and attached across the corner of a crib.

FIG. 2 is a partial cross-sectional view of the invention taken along the lines 2—2 in FIG. 1.

FIG. 3 is a top plan view of the invention taken along the lines 3—3 in FIG. 2.

FIG. 4 is a cross-sectional view of the present invention taken along the lines 4—4 in FIG. 3.

DETAILED DESCRIPTION OF THE INVENTION

Referring to the drawings wherein like numerals indicate like elements, there is shown in FIG. 1 a mobile constructed in accordance with the principles of the present invention and designated generally as 10. As shown in FIG. 1, mobile 10 spans a corner of a crib 11 between the crib headboard 12 and a crib rail 14. It should be appreciated however, that the mobile 10 may also be attached to the crib rails only, to span the width of the crib, or to one crib rail alone, to span a predetermined length thereof.

When the mobile 10 is positioned to span a corner of the crib as shown in FIG. 1, spring clips 16 and 16' are slidably mounted on the crib rail 14 and the upper surface 18 of headboard 12. Spring clips 16 and 16' are identical elements shown in greater detail in FIGS. 2 and 3. Spring clip 16 is provided with an elastic cylindrical wall 20 connected to a flanged member 22 and a housing 24 for supporting a flexible arcuate rod 26. The housing 24, wall 20 and flanged member 22 comprise a unitary structure made of an elastic material such as plastic.

The interior surface 28 of wall 20 and the interior surfaces 30 and 32 of housing 24 and flanged member 22, respectively, frictionally engage the crib rail 14. The spring clip 16 may be opened and removed from frictional engagement with crib rail 14 by application of an external force thereto. Thus, by grasping flanged member 22 and lifting the same upwardly and away from crib rail 14, the elastic wall 20 will deform to cause spring clip 16 to open and release crib rail 14.

Arcuate rod 26 is flexible but self-supporting having a fixed length. That is, under its own weight, rod 26 assumes a variety of arcuate shapes depending on the separation of spring clips 16 and 16'. The closer spring clips 16 and 16' are to each other, the more pronounced the arc of rod 26. As the clips are separated the rod deforms to an arc which is less pronounced. Rod 26, however, supports FIGS. 42 without deforming under the weight of the figures. Preferably, rod 26 is a flexible material such as plastic.

Rod 26 is rotatably supported by spring clips 16 and 16'. In particular, arcuate rod 26 is seated within cylindrical well 34 in housing 24, FIG. 2. When seated in well 34, the rod is frictionally engaged by the cylindrical interior surface 36 of the well. Thus, spring clip 16 can be rotated about the portion of rod 26 seated within well 34 to permit the mobile 10 to be positioned across a corner of the crib 11, across the width of the crib, or only along one side of the crib. The separation of the spring clips can be varied to provide a greater or lesser arc to rod 26.

Arcuate tubes 38 and 38' each enclose a predetermined length of arcuate rods 26, FIG. 1. Tubes 38 and 38' are identical elements made of a flexible material such as plastic. The tubes slidably engage rod 26 and may rest on platforms 40 and 40' of spring clips 16 and 16', respectively, FIGS. 1 and 2. The tubes may be displaced along rod 26 as will be described in greater detail below.

A plurality of figures, such as paper or plastic cutouts, painted decorations and so forth, may be suspended by wire 44 from annular members 46 which frictionally engage rod 26, FIG. 1. Preferably, annular members 46 are plastic. Each annular member 46 is a unitary structure having a circular wall 48 which encloses a flat disc 50 recessed therein, FIG. 4. A tab 52 extends outwardly from wall 48 and disc 50. Tab 52 is provided with an opening 54 through which wire 44 can be strung. Preferably, wire 44 is transparent. FIG. 42 is suspended on the wire.

Disc 50 is provided with an irregularly shaped oblong opening 56 through which rod 26 extends. Opening 56 is shaped such that rod 26 is frictionally engaged by either two parallel walls 56*a* and 56*b* or walls 56*a* and 56*b* and one of the arcuate walls 56*c* and 56*d*. Annular member 46 can be grasped at tab 52 and caused to slide on rod 26. Since opening 56 is irregularly shaped, the area of contact between disc 50 and rod 26 is reduced. Thus, frictional opposition to the sliding motion of annular member 46 on rod 26 is decreased.

The FIGS. 42 suspended from the annular members 46 provide a source of visual excitement for an infant lying in the crib. In the preferred embodiment described herein, FIGS. 42 are suspended by wires 44 so as to be out of the infant's reach. The tubes 38 and 38' are provided to prevent FIGS. 42 from falling within the infant's reach. The tubes limit the displacement of annular members 46 toward the sides of the crib at which spring clips 16 and 16' are attached. Thus, tube 38 limits the displacement of annular member 46 towards spring clip 16 by contacting disc 50, FIG. 2. The outer diameter of tube 38 exceeds the size of the gap between walls 56*a* and 56*b* in opening 56. Stated otherwise, tube 38 does not pass through opening 56. Accordingly, annular member 46 is prevented from sliding any lower on rod 26. The FIG. 42 suspended from annular member 46 contacted by tube 38 is therefore prevented from falling within the infant's reach.

Although tubes 38 and 38' are shown in FIG. 1 as resting on platforms 40 and 40' of spring clips 16 and 16', respectively, it should be understood that the tubes are slidably mounted on rod 26 and can be positioned elsewhere on the rod. It should also be noted that, although opening 56 in disc 50 has been described as being irregularly shaped, the opening may be of any shape and size which insures slidable engagement of rod 26 with the interior wall or walls of the opening. Thus, for example, the opening 56 may also be circular or square.

The mobile 10 is of relatively simple fabrication and may be pre-assembled and conveniently shipped without any loose parts.

The present invention may be embodied in other specific forms without departing from the spirit or essential attributes thereof and, accordingly, reference should be made to the appended claims, rather than to the foregoing specification as indicating the scope of the invention.

I claim:

1. A mobile for slidable attachment to a crib, comprising:

a flexible arcuate rod;

means slidably mounted on said rod for suspending figures therefrom;

means slidably mounted on said rod for limiting displacement of said suspending means on said rod; and elastic means for rotatably supporting said rod and for frictionally engaging said crib while being slidable thereon.

2. The mobile according to claim 1 wherein said suspending means comprises:

a disc provided with an opening through which said rod extends in frictional engagement with said disc; and a tab for suspending at least one of said figures.

3. The mobile according to claim 2 wherein said limiting means includes one or more tubes through which said rod extends for preventing said disc from sliding over a predetermined portion of said rod.

4. The mobile according to claim 1 wherein said elastic means comprises:

an elastic cylindrical wall;

a flanged member connected to said cylindrical wall for causing elastic deformation of said wall in response to an external force applied to said flanged member; and a housing connected to said wall having a well for rotatably seating said rod.

5. A mobile for slidable attachment to a crib, comprising:

a flexible arcuate rod;

one or more members slidably mounted on said rod for suspending figures therefrom;

one or more tubes slidably mounted on said rod for preventing said members from sliding over a predetermined portion of said rod; and an elastic clip for rotatably supporting said rod and for frictionally engaging said crib while being slidable thereon provided with an elastic cylindrical wall, a housing for rotatably supporting said rod and a flanged member for causing elastic deformation of said wall in response to an external force applied thereto.

6. The mobile according to claim 5 wherein said member slidably mounted on said rod includes a disc provided with an opening through which said rod extends in frictional engagement with said disc, and a tab for suspending at least one of said figures.

7. The mobile according to claim 5 wherein said clip is plastic.

8. A mobile for slidable attachment to a crib, comprising:

a flexible arcuate rod;

means slidably mounted on said rod for suspending figures therefrom; and elastic means for rotatably supporting said rod and for frictionally engaging said crib while being slidable thereon.

9. The mobile according to claim 8 including means slidably mounted on said rod for limiting displacement of said suspending means on said rod.

10. The mobile according to claim 8 wherein said elastic means is plastic.

11. The mobile according to claim 8 wherein said rod is rotatably seated in said elastic means.

12. A pre-assembled mobile for slidable attachment to a crib, comprising:

a flexible arcuate rod;

means slidably mounted on said rod for suspending figures therefrom; and elastic means for rotatably supporting said rod and for frictionally engaging said crib while being slidable thereon.

* * * * *